United States Patent [19]

Kitagawa

[11] Patent Number: 5,021,310

[45] Date of Patent: Jun. 4, 1991

[54] ELECTROPHOTOGRAPHIC PHOTORECEPTOR

[75] Inventor: Seizou Kitagawa, Kanagawa, Japan

[73] Assignee: Fuji Electric Co., Ltd., Kawasaki, Japan

[21] Appl. No.: 368,237

[22] Filed: Jun. 16, 1989

[51] Int. Cl.[5] ..... G03G 15/08; G03G 15/02; G03G 5/00

[52] U.S. Cl. ..... 430/85; 430/58; 430/128; 430/132

[58] Field of Search ..... 430/132, 128, 85

[56] References Cited

U.S. PATENT DOCUMENTS

| | | | |
|---|---|---|---|
| 3,973,960 | 8/1976 | Dulken et al. | 430/85 |
| 4,314,014 | 2/1982 | Yamamoto et al. | 430/57 |
| 4,880,717 | 11/1989 | Kitagawa et al. | 430/85 X |
| 4,891,290 | 1/1990 | Narita . | |
| 4,920,025 | 4/1990 | Sweatman et al. | 430/128 |

*Primary Examiner*—Marion E. McCamish
*Assistant Examiner*—S. C. Crossan
*Attorney, Agent, or Firm*—Brumbaugh, Graves, Donohue & Raymond

[57] ABSTRACT

An electrophotographic photoreceptor is provided comprising, in sequence:

a) a conductive base;
b) a carrier transport layer;
c) a carrier generation layer comprising a selenium alloy;
d) a carrier injection regulating layer having a band gap energy greater than that of the carrier generation layer and comprising selenium and up to about 10 weight % arsenic;
e) a thermal expansion relieving layer comprising arsenic and selenium; and
f) a surface protective layer comprising arsenic and selenium in an atomic ratio of approximately 2 to 3;

wherein the arsenic concentration in the thermal expansion relieving layer gradually increases from a concentration substantially equal to that of the carrier injection regulating layer on a face of the thermal expansion relieving layer adjacent to the carrier injection regulating layer to a concentration substantially equal to that of the surface protective layer on an opposite face of the thermal expansion relieving layer adjacent to the surface protective layer. This structure eliminates or reduces damage to the photoreceptor caused by thermal stress when the carrier generation layer and the carrier injection regulating layer have greater thermal expansion coefficients than the $As_2Se_3$ of the surface protective layer.

1 Claim, 1 Drawing Sheet

ELECTROPHOTOGRAPHIC PHOTORECEPTOR

BACKGROUND OF THE INVENTION

The present invention relates to an electrophotographic photoreceptor of a function separation type which comprises a substrate, a carrier generation layer, a carrier transport layer, a surface protective layer, and a carrier injection regulating layer between the charge generation and surface protective layer. The photoreceptor of the invention is further provided with a thermal expansion relieving layer between the carrier injection regulating layer and the surface protective layer.

In a printer of an electrophotographic system, light of long wavelength, such as 630 to 800 nm, projected from an exposure source such as a light emitting diode, a semiconductor laser or a gas laser, is used as writing light for forming an electrostatic latent image on the surface of a photoreceptor. In such a printer, a function separation type photoreceptor composed of a carrier generation layer which has a high sensitivity even to long wavelength light, a carrier transport layer for transport the carriers produced in the carrier generation layer, and a surface protective layer for protecting the carrier generation layer from external stress are generally used.

In addition, in order to prevent the electrons produced from the carrier generation layer by means other than exposure, e.g., due to thermal excitation, from lowering the retention of the positive charges electrified on the surface, a carrier injection regulating layer consisting of a high Se alloy and having a wide band gap is frequently inserted between the carrier transport layer and the surface protective layer. As to other materials, a high-concentration Te—Se alloy is generally used for the carrier generation layer, amorphous Se material for the carrier transport layer and a low-concentration As—Se alloy for the surface protective layer.

The surface protective layer is an important layer that determines the printing durability of a photoreceptor. A low-concentration As—Se alloy is generally used for the surface protective layer because it has a high thermal expansion as compared with $As_2Se_3$. Such a material is used in order to avoid cracking due to differences in thermal expansion coefficients of the surface protective layer and the carrier transport layer, which is usually made of an amorphous Se material having a very large thermal expansion coefficient. Unfortunately, these low concentration As—Se alloys have very poor mechanical strength. Accordingly, such a photoreceptor disadvantageously has an insufficient printing durability.

Since it would be possible to enhance the mechanical strength of the surface protective layer by simultaneously lowering the thermal expansion coefficients of the carrier transport layer and the surface protective layer, an Se—Te—As function separation type photoreceptor for a laser beam printer having a high printing durability has recently been developed. In this Se—Te—As photoreceptor, an $As_2Se_3$ alloy is used for both the carrier transport layer and the surface protective layer. Since the outermost surface layer consists of an $As_2Se_3$ alloy, such a photoreceptor realizes a high printing durability on the same level as a conventional $As_2Se_3$ photoreceptor. However, this photoreceptor has poor thermal resistance. That is, since the thermal expansion coefficients of the underlayers, namely, the carrier generation layer and the carrier injection regulating layer are twice that of the surface protective layer, when the photoreceptor is stored at a temperature of 50° C., the carrier generation layer and the carrier injection regulating layer largely expand, thereby producing cracking in the surface protective layer.

Accordingly, it is an object of the present invention to eliminate the above-described defects in the prior art and to provide an electrophotographic photoreceptor having a high printing durability and a high thermal resistance without deterioration of various properties required of a photoreceptor.

SUMMARY OF THE INVENTION

To achieve this aim, the present invention provides an electrophotographic photoreceptor comprising, in sequence:

a) a conductive base;
b) a carrier transport layer;
c) a carrier generation layer comprising a selenium alloy;
d) a carrier injection regulating layer having a band gap energy greater than that of the carrier generation layer and comprising selenium and up to about 10 weight % arsenic;
e) a thermal expansion relieving layer comprising arsenic and selenium; and
f) a surface protective layer comprising arsenic and selenium in an atomic ratio of approximately 2 to 3;

wherein the arsenic concentration in the thermal expansion relieving layer gradually increases from a concentration substantially equal to that of the carrier injection regulating layer on a face of the thermal expansion relieving layer adjacent to the carrier injection regulating layer to a concentration substantially equal to that of the surface protective layer on an opposite face of the thermal expansion relieving layer adjacent to the surface protective layer. This structure eliminates or reduces damage to the photoreceptor caused by thermal stress when the carrier generation layer and the carrier injection regulating layer have greater thermal expansion coefficients than the $As_2Se_3$ of the surface protective layer.

DETAILED DESCRIPTION OF THE INVENTION

The present invention avoids cracking in the surface protective layer of a positively charged photoreceptor in a high-temperature atmosphere which arises due to a difference in thermal expansion between the carrier generation layer and the carrier injection regulating layer on the one hand and the surface protective layer on the other. The thermal resistance of the device is enhanced without deteriorating other properties of the photoreceptor by providing a thermal expansion relieving layer between the carrier injection regulating layer and the surface protective layer, wherein the As concentration of the thermal expansion relieving layer gradually varies from the composition of the carrier injection regulating layer to the composition of the surface protective layer.

By providing a thermal expansion relieving layer in which the As concentration gradually increases and the thermal expansion coefficient approximates that of the surface protective layer, the thermal expansions of the carrier generation layer and the carrier injection regulating layer in a high-temperature atmosphere are absorbed, thereby preventing the production of cracks in the surface protective layer.

Figure 1:
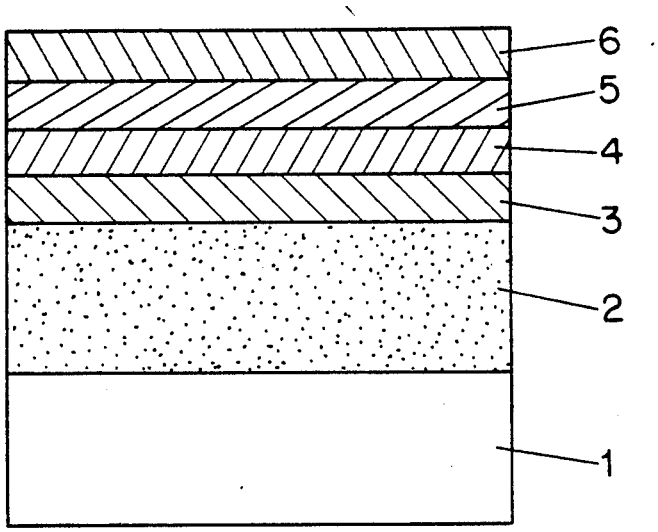
FIG. 1 is a sectional view of an embodiment of an electrophotographic photoreceptor according to the present invention.
Figure 2:
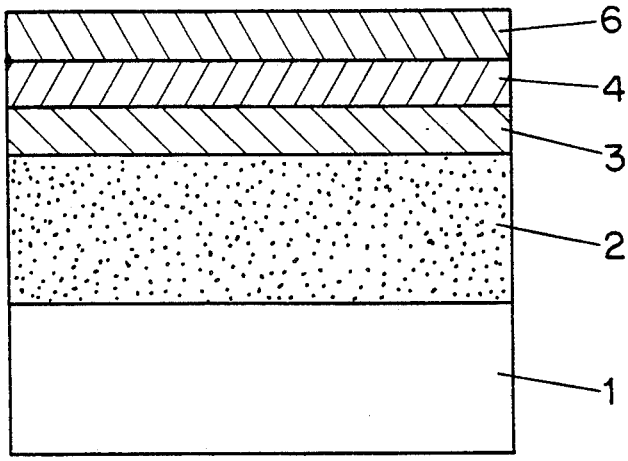
FIG. 2 is a sectional view of the structure of a comparative example.

FIG. 1 shows the sectional structure of an embodiment of an electrophotographic photosensitive material according to the present invention. The conductive base 1 is preferably composed of a metal such as Al or Ni. The carrier transport layer 2 preferably comprises a 35 to 40 wt % As—Se alloy film of a thickness of about 50 to 80 μm on the conductive base 1. The composition and the thickness of the carrier generation layer 3 are determined by the wavelength of light used for the exposure of an image. Preferably, the carrier generation layer is a film of 0.1 to 1 μm thick and is an As—Te alloy having a Te concentration of 30 to 50 wt %. The carrier injection regulating layer 4 preferably comprises an approximately 10 wt % As—Se alloy film having a wider band gap than the carrier generation layer 3 and a thickness of about 0.1 to 2 μm.

The thermal expansion relieving layer 5 composed of an Se—As alloy is provided between the carrier injection regulating layer 4 and the surface protective layer 6. The thermal expansion relieving layer 5 is composed so that the As concentration thereof in the vicinity of the carrier injection regulating layer 4 is about 10 wt %, which is almost the same as the As concentration of the carrier injection regulating layer 4. The concentration of As in the thermal expansion relieving layer 5 gradually increases in the direction toward the surface protective layer 6 and reaches the same As concentration of the surface protective layer 6 in the vicinity of the surface protective layer 6. The thermal expansion relieving layer 5 is formed to a film thickness of 0.5 to 3 μm. If it is too thin, there is no effect, while too thick a film deteriorates the sensitivity and the residual potential characteristic.

The surface protective layer 6 is composed of a 35 to 40 wt % alloy which is approximate to $As_2Se_3$, and generally has a thickness of 1 to 5 μm. Up to 1500 ppm of iodine may be added to the layers other than the carrier generation layer 3 in order to accelerate the movement of charges. Addition of more than 1500 ppm of iodine is unfavorable, causing dark decay.

The following non-limiting examples describe four kinds of photoreceptors having the above-described structure, as well as comparative examples.

EXAMPLE 1

In this photoreceptor, the thickness of the thermal expansion relieving layer was 2 mm and the As concentration was 5 wt % in the vicinity of the carrier injection regulating layer and 36.8 wt % in the vicinity of the surface protective layer.

In order to manufacture this photoreceptor, an aluminum material pipe 80 mm in diameter which had been machined and washed was laid in evaporation equipment, which was evacuated to $1\times10^{-5}$ Torr while maintaining the temperature of the base at 190° C. A boat accommodating 36.8 wt % As—Se alloy was heated to 380° C. so as to deposit the 36.8 wt % As—Se alloy on the material pipe to a thickness of 60 μm as the carrier transport layer. 44 wt % Te—Se alloy and 5 wt % As—Se alloy were deposited by flash deposition as the carrier generation layer and the carrier injection regulating layer, respectively, to thicknesses of 1 μm each. An Se—As alloy was next deposited by flash deposition as the thermal expansion relieving layer such that the As concentration varied from 5 wt % to 26.8 wt % with the progress of evaporation. The overall film thickness of the thermal expansion relieving layer was 2 μm. Finally, 36.8 wt % As—Se alloy was deposited by flash deposition to a thickness of 2 μm as the surface protective layer.

EXAMPLE 2

In this photoreceptor, the carrier transport layer and the surface protective layer, respectively, contained 1000 ppm of iodine, and the carrier injection regulating layer contained 100 ppm of iodine. The thickness of the thermal expansion relieving layer was 1 μm and the As concentration was 10 wt % in the vicinity of the carrier injection regulating layer and 38.7 wt % in the vicinity of the surface protective layer.

In order to manufacture this photoreceptor, an aluminum material pipe 80 mm in diameter which had been machined and washed was laid in evaporation equipment, which was evacuated to $1\times10^{-5}$ Torr while maintaining the temperature of the base at 200° C. A boat accommodating an $As_2Se_3$ alloy with 1000 ppm of iodine added thereto was heated to 400° C. so as to deposit the $As_2Se_3$ alloy with 1000 ppm of iodine added thereto on the material pipe to a thickness of 60 μm as the carrier transport layer. 46 wt % Te—Se alloy containing 100 ppm of iodine was deposited by flash deposition as the carrier generation layer to a thickness of 0.5 μm. 10 wt % As—Se alloy containing 100 ppm of iodine was deposited by flash deposition as the carrier injection regulating layer to a thickness of 1 μm. An Se—As alloy was next deposited by flash deposition as the thermal expansion relieving layer such that the As concentration varied from 10 wt % to 38.7 wt % with the progress of evaporation. The overall film thickness of the thermal expansion relieving layer was 1 μm. Finally an $As_2Se_3$ alloy containing 1000 ppm of iodine was deposited by flash deposition to a thickness of 3 μm as the surface protective layer.

The photoreceptors in comparative Examples 3 and 4 had the same structure as the photoreceptors in Examples 1 and 2, respectively, except that the photoreceptors of Examples 3 and 4 did not have thermal expansion relieving layers. The electrical characteristics, the fatigue properties and the thermal resistance of each of these photoreceptors were evaluated. The results are shown in Table 1.

TABLE 1

| Photo-receptor | Electric characteristics (V) Half decay exposure (lx · sec) | Residual potential (V) | Fatigue property Charging potential | Thermal resistance Left at 50° C. |
|---|---|---|---|---|
| Example 1 | 0.8 | 35 | 48 | No cracking was produced even after 1000 hr |
| Example 2 | 0.6 | 30 | 48 | |
| Comparative Example 3 | 0.8 | 30 | 45 | Cracking was produced after 75 hr |
| Comparative Example 4 | 0.6 | 25 | 50 | Cracking was produced after 100 hr |

Table 1 shows that the photoreceptor according to the present invention has excellent thermal expansion resistance and is by no means inferior to the comparative examples having no thermal expansion relieving layer provided above with respect to electric characteristics and fatigue properties.

I claim:

1. An electrophotographic photoreceptor, which comprises, in sequence:

a) a conductive base;

b) a carrier transport layer comprising arsenic and selenium in an atomic ratio of approximately 2 to 3;

c) a carrier generation layer comprising a selenium alloy;

d) a carrier injection regulating layer having a band gap energy greater than that of the carrier generation layer and comprising selenium and up to about 10 weight % arsenic;

e) a thermal expansion relieving layer comprising arsenic and selenium; and f) a surface protective layer comprising arsenic and selenium in an atomic ratio of approximately 2 to 3; wherein the arsenic concentration in the thermal expansion relieving layer gradually increases from a concentration substantially equal to that of the carrier injection regulating layer on a face of the thermal expansion relieving layer adjacent to the carrier injection regulating layer to a concentration substantially equal to that of the surface protective layer on an opposite face of the thermal expansion relieving layer adjacent to the surface protective layer, whereby damage to the photoreceptor caused by thermal stress is reduced.

* * * * *

UNITED STATES PATENT AND TRADEMARK OFFICE

CERTIFICATE OF CORRECTION

PATENT NO. : 5,021,310

DATED : June 4, 1991

INVENTOR(S) : Seizou Kitagawa

It is certified that error appears in the above-identified patent and that said Letters Patent is hereby corrected as shown below:

On title page, add item

--[30] Foreign Application Priority Data
June 16, 1988 [JP] Japan----------63-148987--;

Item [57] Abstract, lines 11-12, "aresenic" should read --arsenic--.

Signed and Sealed this

Fifth Day of October, 1993

Bruce Lehman

*Attest:*

BRUCE LEHMAN

*Attesting Officer*

*Commissioner of Patents and Trademarks*